US005838636A

United States Patent [19]

Ashford et al.

[11] Patent Number: 5,838,636

[45] Date of Patent: Nov. 17, 1998

[54] UNDERWATER VEHICLE GUIDANCE SYSTEM AND METHOD

[75] Inventors: Robert L. Ashford, Pearl City, Hi.; David F. Bleil, Silver Spring; Zaka I. Slawsky, Bethesda, both of Md.

[73] Assignee: The United States of America as represented by the Secretary of the Navy, Washington, D.C.

[21] Appl. No.: 839,789

[22] Filed: Jun. 24, 1969

[51] Int. Cl.[6] ..... G01S 15/00

[52] U.S. Cl. ..... 367/95

[58] Field of Search ..... 340/2, 3, 5, 16 R; 114/21, 23, 21.1, 21.2; 367/95, 96, 901

[56] References Cited

U.S. PATENT DOCUMENTS 3,161,168 12/1964 Rebikoff .

3,183,478 5/1965 Slawsky et al. .

*Primary Examiner*—Daniel T. Pihulic

[57] ABSTRACT

A system and a method for directing a torpedo toward a submerged or surface target by transmitting steering information to the torpedo via sonic pulses. A suitable underwater surveillance system, such as the Correlation Sonobuoy System, provides an observer with the necessary information regarding the relative bearings of both the torpedo and the target. Using sonic signals generated by one of a variety of suitable sources, the torpedo is steered into the general vicinity of the target while the positions of both torpedo and target are tracked on the underwater surveillance system display. Once directed to the general area of the target by this technique, the torpedo's internal target homing system is activated either automatically or by additional sonic pulses to complete the attack on the target.

9 Claims, 2 Drawing Sheets

UNDERWATER VEHICLE GUIDANCE SYSTEM AND METHOD

CROSS REFERENCES

The correlation sonobuoy system which may be used with this invention is disclosed in U.S. Pat. No. 3,183,478 of common assignee herewith, and is described in combination with a wire guided torpedo in copending application Ser. No. 469,060, now U.S. Pat. No. 3,783,441, of Zaka I. Slawsky, filed Jun. 30, 1965, of common assignee herewith.

BACKGROUND OF THE INVENTION

This invention relates generally to underwater vehicle guidance techniques and more particularly to a system and method for guiding a torpedo toward a moving target.

Hitting a rapidly moving submerged target capable of radical evasive maneuvers, such as a submarine, with a torpedo is a difficult task to accomplish. To some degree however, recent developments in underwater surveillance techniques, such as the Correlation Sonobuoy System have served to simplify the problem. In the Correlation Sonobuoy System, the advantages of which are clearly set forth in application Ser. No. 469,060, now U.S. Pat. No. 3,783,441, three pairs of sonobuoys containing listening devices are deployed in the vicinity of the target. Low frequency sounds, such as noise, generated by the target, as well as the attacking torpedo are detected by the listening devices, and then transmitted over radio channels by transmitters carried within each of the buoys to processing circuitry mounted in a remote observation vehicle, such for example as a helicopter. The processing circuitry provides a visual display of the relative bearings of both the target and the torpedo as they travel beneath the surface of the sea. Using the displayed information, an observer or a suitable computer can direct the torpedo into the vicinity of the target by sending appropriate steering information to the torpedo.

Transmitting steering information to a torpedo travelling underwater from a remote observation vehicle, is complicated because of the diverse signal propagating characteristics of the air and sea mediums separating the tracking vehicle, and the torpedo. To overcome this complication, a technique of guiding torpedoes through wire connected to surface buoys was developed and is disclosed in application Ser. No. 469,060, now U.S. Pat. No. 3,783,441. According to this technique, an observer sends steering commands from an observation vehicle over a radio channel to a surface buoy where the signals are transduced and transmitted as electrical impulses over a wire connecting the torpedo with the surface buoy thereby appropriately operating the torpedo steering mechanism to direct it to the target. While the wire guiding technique is workable, it presents a host of practical problems which limit its usefulness. For example, the delivery of the torpedo is complicated by the weight of the carried wire, the range of the torpedo is limited by the length of the wire and the loss of control of the torpedo due to wire breakage or fouling is an ever present hazard.

Consequently, there is a need for a more flexible technique of guiding submerged torpedoes which will alleviate the aforenoted disadvantages and generally improve techniques for guiding submerged torpedoes toward desired targets.

SUMMARY OF THE INVENTION

Accordingly, one object of this invention is to provide a new and improved system for remotely guiding vehicles travelling in a water medium.

Another object of the invention is to provide a new and improved system for quickly and reliably steering a torpedo toward a target.

A further object of the invention is to provide a new and improved system for remotely directing a one or more submerged torpedoes toward a rapidly moving submerged target.

Still another object of the invention is the provision of a novel method for effecting the remote direction of submerged torpedoes toward rapidly moving targets capable of radical evasive manuevers.

Briefly, these and other objects are attained by deploying a torpedo having an internal guidance system and a hydrophone capable of sensing sonic pulses generated by a suitable source located in the general vicinity of a target vessel. Once deployed, the torpedo is directed toward the target by first observing the relative bearings of the target and the torpedo on a suitable underwater surveillance system, such as the Correlation Sonobuoy System, and then transmitting steering information to the torpedo in the form of sonic pulses until the torpedo is within the acquisition range of its own internal homing mechanism.

BRIEF DESCRIPTION OF THE DRAWINGS

A more complete appreciation of the invention and the many attendant advantages thereof will be readily appreciate as the same becomes better understood by reference to the following detailed description when considered in conjunction with the accompanying drawings wherein.

DESCRIPTION OF THE PREFERRED EMBODIMENT

Figure 1:
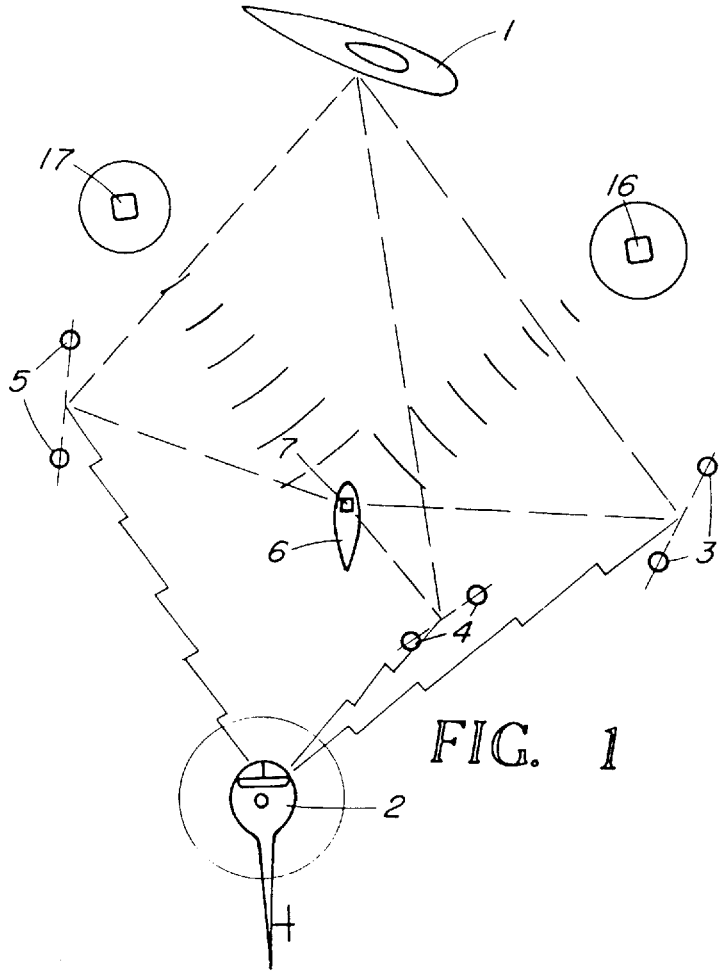
FIG. 1 is a plan view of the general technique of target attack using the instant torpedo guidance system and method.

Referring now particularly to FIG. 1, a submerged target 1, such as a submarine, which has been located approximately by techniques not a part of this invention, is shown as being approached by a tracking vehicle 2, which may be either an aircraft or a vessel, carrying an observer who is to direct the torpedo attack. If the aforedescribed Correlation Sonobuoy System of underwater surveillance is to be used, the tracking, or another, vehicle launches three pairs of sonobuoys 3, 4 and 5 in the general vicinity of the target. A torpedo 6, having a sonic target homing system 7 is also launched either from the tracking vehicle or another source in the general direction of the target. Signals generated by the target 1 and torpedo 6 are intercepted by the sonobuoys pairs 3, 4 and 5 and are transmitted to and received by a system in the tracking vehicle which visually displays to the observer in the tracking vehicle the relative positions of the target and the torpedo.

Figure 2:
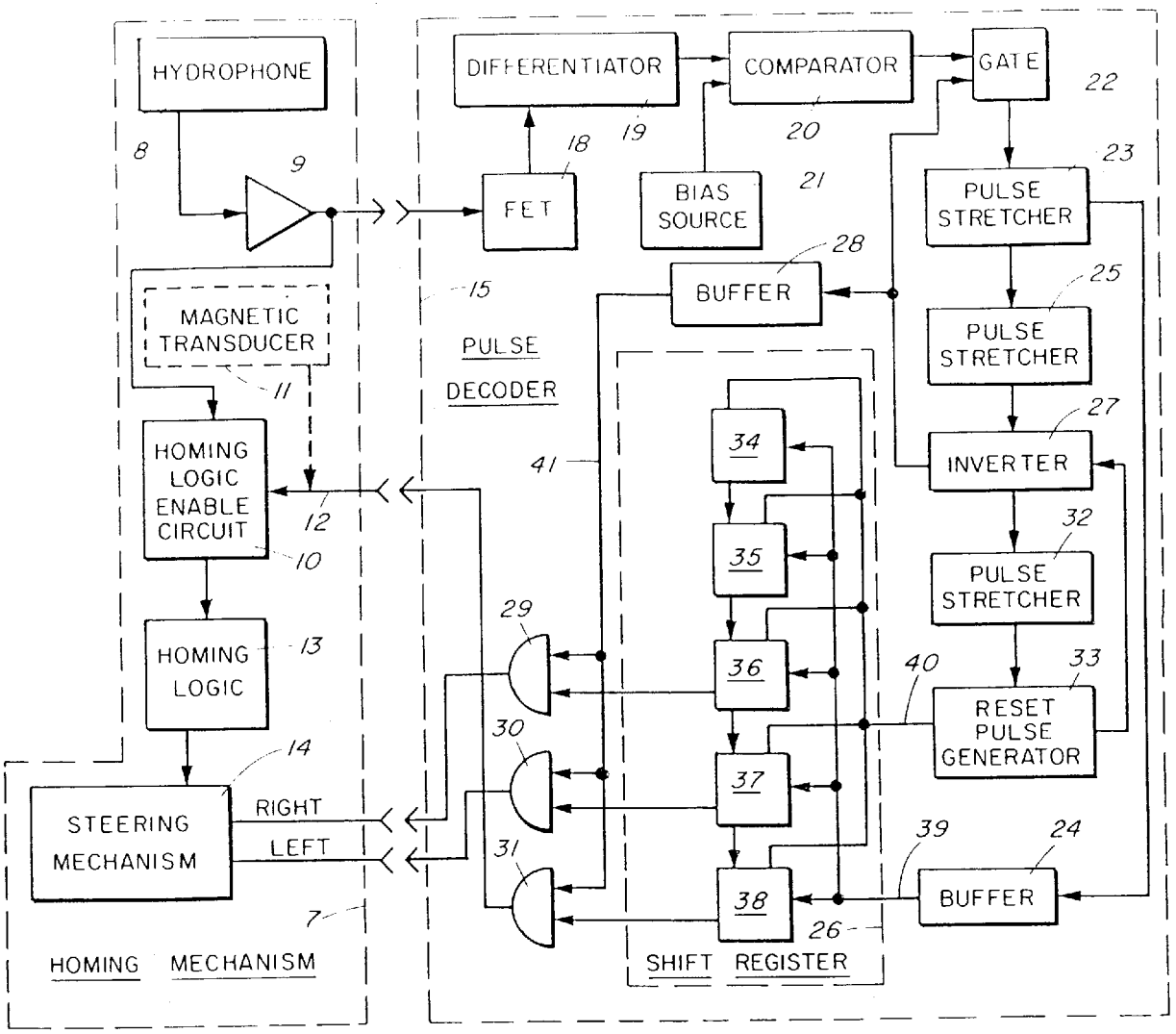
FIG. 2 is a block diagram of the torpedo guidance system of the instant invention.

As more clearly shown in FIG. 2 the homing mechanism 7 includes a hydrophone 8 capable of detecting acoustic energy transmitted in the surrounding water generates an electrical output representing the acoustic signal which is fed through an amplifier 9 to homing logic enable circuit 10 which selectively transfers guidance control of the torpedo to its automatic homing mechanism. The homing logic enable circuit be optionally activated by a magnetic transducer 11, which detects the presence of a target or by an equivalent enable signal applied to input line 12, or the circuit may be set so that the torpedo is fixed in its automatic homing mode at all times. When the torpedo is in its automatic homing mode, the homing logic 13 operates to steer it toward the source of the sound detected by hydrophone 8 by generating and feeding appropriate steering instructions to suitable steering mechanism 14. As the target acquisition range of the automatic homing mechanism is limited to a few hundred yards, the technique described hereinafter is necessary to place a torpedo which may have been launched up to several miles from a target within its automatic homing range.

In its simplest embodiment, the instant invention provides a method whereby the torpedo 6 having a homing mechanism 7 may be remotely directed toward target 1, by planting sonic impulse sources 16 and 17 in the water, one in the vicinity generally to the left of the torpedo's desired course and one in the vicinity generally to the right thereof. Either of these sources may be triggered by the observer to emit a sonic impulse which is detected by the torpedo hydrophone 8 thereby effecting actuation of the torpedo's homing mechanism for a short interval, with the result that the torpedo is turned generally toward the direction of the triggered sonic source. Sharper torpedo turns can be caused by triggering multiple sonic pulses or by adjusting the torpedo's turning mechanism to make it more sensitive. Similarly, a third pair of sonic impulse sources may be planted above and below the torpedo's desired course to permit control of the torpedo's running depth. The torpedo is steered in this manner by the observer until it is within the range at which its internal homing mechanism is capable of acquiring, or locking onto, the target to complete the attack automatically.

A wide variety of sonic impulse sources are available for use with this embodiment of the invention, such as ordinary fuzed explosives, radio controlled multiple charge explosive packages, sonic pulse generators built into the sonobuoys, or other suitable sonic sources such as a projectile fired into the sea from a gun.

In addition to acting as command pulse sources, these pulse sources may be used to "illuminate" the target if it goes silent in an effort to avoid the attack. An explanation of the theory of "illumination" of targets and its attendant advantages is set forth in copending application Ser. No. 469,060, now U.S. Pat. No. 3,783,441.

While the aforedescribed technique possesses the advantages of simplicity of implementation, under certain conditions it is susceptible to confusion by spurious sonic signals, such as echo pulses reflected from the sea bottom or surface. To eliminate these shortcomings, an alternative technique is provided wherein coded sonic pulses are used to command a torpedo having a homing mechanism modified to include a pulse decoder 15. The advantages of using coded pulse command techniques include improved control flexibility as well as additional resistance to countermeasures and spurious signals. In addition, only a single source of sonic command pulses, triggered by the observer or by a computer according to the proper code, is necessary to transmit all required steering information to the torpedo.

Referring now to FIG. 2, coded sonic command pulses initiated by the observer using any of the afore identified sources are initially sensed by hydrophone 8 which converts them into representative electronic pulses to be fed to amplifier 9. Both the hydrophone and the amplifier may be part of the torpedo's internal homing mechanism. The output of amplifier 9 is fed into the decoder 15 via a high input impedance circuit, such for example as a conventional field effect transistor (FET) 18 for preventing the added decoding circuitry from loading amplifier 9. The FET output is passed through a differentiating network 19, which removes the d.c. component of the signal from the FET. The signal is then applied to a conventional comparator 20 having a bias source 21 settable to a desired level to permit the comparator to produce an output only if the signal from differentiating network 19 has a magnitude larger than that of the bias source voltage, thereby filtering out background noise and spurious pulses. The output pulse generated by the comparator passes through a normally open gate 22 to a conventional pulse stretcher 23. The pulse stretcher acts as a time delay in that it prevents the transmission of a pulse to the subsequent components of the decoder until a fixed period of time has elapsed, thereby preventing the decoder from responding to spurious pulses such, for example, as sea bottom and surface echoes, that closely follow command signals. Pulse stretcher 23 also serves to establish the minimum time separation that must be maintained between control pulses to permit the decoder to distinguish one pulse from another. The output of pulse stretcher 23 is fed simultaneously to a conventional shift register 26 through a buffer 24 and to a second pulse stretcher 25. The buffer serves as an impedance matching stage between pulse stretcher 23 and shift register 26. Pulse stretcher 25 serves to establish the total operating interval of the decoder during which gate 22 is open and a single steering command may be received. The output of pulse stretcher 25 drives an inverter 27 which inverts the sense of the pulse received from pulse stretcher 25 for the purpose of resetting gate 22 which requires a resetting pulse of opposite sense from that of stretcher 25. Thus, it is seen that the output from pulse stretcher 25 is inverted by inverter 27, fed back to gate 22, closing the gate, and thereby isolating all of the input components of the decoder from all of its processing components. The purpose of closing the gate at the end of the instruction cycle determined by pulse stretcher 25 is to prevent additional information from entering the decoder while instructions which have been stored in shift register 26 are being readout. This operation will become clearer as the functional interrelationships of the remaining components are described.

The same pulse from inverter 27 that closes gate 22 is simultaneously fed through a buffer 28 to a plurality of individual readout gates 29, 30 and 31 to enable the gates, and transfer the information stored in shift register 26 to the steering mechanism 14 and homing logic enable circuit 10 of the torpedo's homing mechanism 7.

The output of inverter 27 is also connected to a third pulse stretcher 32 which defines the length of the readout interval (the interval during which gate 22 is closed). At the termination of the interval established by pulse stretcher 32, its output is fed to a reset pulse generator 33 which serves to clear the shift register 26 and to reset inverter 27 and reopen gate 22, returning the decoder to its initial condition.

Shift register 26 serves as the primary memory and decoding element of the pulse decoder 15 and is shown in its preferred embodiment as having five binary stages 34 through 38, each interconnected in the conventional fashion and each receiving an input pulse in parallel through input circuit 39. Initially, the first binary stage 34 is set in its logical "one" state representing stored information, while the remaining stages are set in their logical "zero" states, representing the absence of stored information. As each pulse is received by the shift register through input circuit 39, the "one" state is shifted sequentially from stage to stage along the register. For example, after the first input pulse is received, stage 35 is set to its "one" state, and stages 34, 36, 37 and 38 are set in their "zero" states. The receipt of a second pulse transfer the "one" state to stage 36 while all of the other stages are set to their "zero" stages. This, process continues until four pulses are received, at which time the "one" stage is transferred to the last stage 38 of the shift register, and all other stages are in their "zero" state. The next pulse transfers the "one" state out of the register, with the result that all stages then remain in their zero state regardless of how many input pulses are received thereafter during the remainder of the operating interval. This operation results from the fact that the shift register only operates to transfer any stored information within it from one stage to the next. Since the only "one" state has been shifted out of the register after five input pulses, only "zero" states remain to be shifted. Thus, the "zero" states are simply shifted from one stage to another until the shift register 26 is reset. A "one" state is again set into the first stage 34 of the shift register upon the receipt of a resetting pulse from reset pulse generator 33 through the reset circuit 40 which is connected in parallel to each of the stages 34 through 38. The resetting pulse so applied sets stages 35 through 38 in their "zero" states, and stage 34 in its "one" state, with the result that the shift register 26 is returned to its initial condition.

Information is stored in shift register 26 in the position of the "one" state within the register. For example the receipt of two pulses by the decoder resulting from two command signals initiated by the observer transfers the "one" state from stage 34 to stage 36 of the register. The information stored in this stage (according to the code that has been selected) indicates that to the torpedo that a right turn has been commanded. Likewise, the receipt of three pulses transfers the "one" state to the fourth stage 37 of the shift register, indicating that a left turn has been commanded. In the same way the receipt of four pulses transfers the "one" state to the final stage 38 of the shift register, indication that an "enable homing mechanism" signal has been sent to the torpedo.

The information so stored in shift register 26 is read out via gates 29, 30 and 31, which are enabled (or opened) by a pulse from buffer 28 applied through circuit 41. As shown in FIG. 2, the readout gates 29, 30 and 31 are connected to the last three stages 36, 37 and 38, respectively, of shift register 26. Thus, when the gates are opened by a readout pulse, they connect stages 36, 37 and 38 directly to the "right" and "left" controls of steering mechanism 14 and the enabling circuit 10 of the torpedo. Consequently, depending upon which stage the information is stored in, it will be transferred directly to the appropriate torpedo control function, and the torpedo will respond accordingly.

Reviewing now the general operation of the decoder as a whole, sonic pulses generated in the water by devices initiated by an observer, are detected and converted into electrical pulses by hydrophone 8 and are processed and passed through gate 22 to pulse stretcher 23, which eliminates the spurious effects of sonic reflections from the sea bottom or surface. An operating interval is then established by a pulse stretcher 25 during which gate 22 remains open, and the pulses are fed to shift register 26. At the termination of the operating interval, a pulse from inverter 27 closes gate 22, while simultaneously activating readout gates 29, 30 and 31. Thus, no pulse can enter the shift register 26 while the stored information is being readout. A short readout interval is established by pulse stretcher 32, after which reset pulse generator 33 is activated. The reset pulse so generated resets shift register 26 to its initial condition, closes readout gates 29, 30 and 31, and reopens gate 22, preparing the entire decoder to respond to the next control command sonic signals.

The disclosed decoder is capable of distinguishing only three control commands, that is, turn right, turn left, and enable automatic homing mode. Obviously, the shift register may be expanded to permit the torpedo's depth to be controlled by the addition of two more stages representing "up" and "down" commands. While the various command codes can be changed within a wide latitude, the selected code offers some advantages in the area of countermeasures resistance. As described above, using the selected code, the first command to the torpedo occurs only after two pulses have been received, thus preventing the torpedo from responding to a single isolated decoy or spurious pulse as might be caused, for example, by a single decoy explosion. Also, after more than four pulses are received no command is transferred to the torpedo, so that repeated decoy signals would be ineffective in diverting the torpedo.

The coded sonic command pulses may be generated by any of the techniques described hereinbefore in connection with the first embodiment of the invention, as well as by other appropriate sources. One such source may be a conventional machine gun mounted on the tracking vehicle and programmed to be fired into the sea at a preset rate by the observer. It is apparent that the decoding logic may be modified to respond to other types of pulse coding, such as pulse position and pulse duration coding. Additional countermeasures resistance can be provided by changing the type of code to be used at frequent intervals.

It is further contemplated that multiple torpedoes may be simultaneously directed without mutual interference by modifying each torpedo to respond to a different type of steering code. The use of multiple codes will, of course, require either plural or extremely flexible sonic pulse generators.

Obviously numerous other modifications and variations of the present invention are possible in light of the above teachings. It is therefore understood that within the scope of the appended claims the invention may be practiced otherwise than is specifically described.

What is claimed as new and desired to be secured by Letters Patent of the United States is:

1. A guidance system for a propelled water vehicle having a steering mechanism, a hydrophone for detecting sonic signals and a homing system responsive to detected sonic signals generated by a short range target to control said steering mechanism comprising means for tracking and indicating the relative paths of the vehicle and target, means for generating sonic command signals in the water correlative to the indication on said tracking means, means for eliminating spurious signals detected by said hydrophone, gating means for passing sonic command signals detected during a predetermined operational period, means for storing said passed sonic command signals, means for applying said passed sonic command signals to said storing means, means for applying the sonic command signals stored in said storage means to the steering mechanism during a predetermined read-out period, means for controlling the length of said operational period and said read-out period, and means for resetting said storing means after said read-out period.

2. A guidance system for a torpedo having a steering mechanism and a homing system responsive to sonic signals generated by a proximate target to control said steering mechanism comprising means remote from the torpedo for tracking and indicating the relative locations of the torpedo and target, means remote from the torpedo for generating sonic command signals in the water corresponding to the indication on said tracking means, means in said torpedo for detecting sonic signals generated by the target and said remote signal generating means and for developing an output pulse signal in response thereto, means coupled to said detection means for translating selected output pulse signals generated by said detection means, first gating means coupled to said last recited means for passing said selected output pulse signals occurring during a predetermined operational period, means for digitally storing said passed selected output pulse signals, means coupled to said first gating means for belatedly applying said passed selected output pulse signals to said storing means, second gating means intercoupling said storing means and the steering mechanism for applying the stored pulse signals to actuate the storing mechanism during a predetermined read-out period, means intercoupling said second gating means and said storing means for determining the length of said operational and read-out periods, and for resetting said storing means after said read-out period.

3. A guidance system for a torpedo as in claim 2 wherein said translating means includes means for excluding sonic background noise and spurious sonic pulses of magnitude less than a predetermined level.

4. A guidance system for a torpedo as in claim 2 wherein said second gating means activates said steering mechanism only if a predetermined number of pulses has been received.

5. A guidance system for a torpedo having a steering mechanism and a homing system responsive to sonic signals generated by a proximate target to control said steering mechanism comprising, means remote from the torpedo for tracking the relative locations of the torpedo and target, means remote from the torpedo for automatically generating sonic command signals in a selected pulse code in the water corresponding to said tracking of the relative locations of the target and torpedo by said tracking means, means in said torpedo for detecting sonic signals generated by the target and said remote signal generating means and for developing output pulses in response thereto, means coupled to said detection means for comparing said output pulses to a settable reference source thereby eliminating any pulse of a magnitude less than that of the reference source and passing those of a magnitude greater than the reference source, gating means coupled to said last recited means for transmitting said passed pulses occurring during a predetermined operating interval, memory means for digitally storing said transmitted pulses and for decoding the stored pulses, means coupled to said gating means for belatedly applying said transmitted pulses to said memory means thereby rendering said memory means nonresponsive to echoes of said sonic command pulses, means intercoupling said memory means and said steering mechanism for reading out the decoded pulses stored in said memory means and applying them to the steering mechanism thereby to actuate the steering mechanism, means connected to said intercoupling means and to said gating means for simultaneously disabling said gating means thereby terminating said operating interval and enabling said intercoupling means thereby establishing a read-out interval, and means connected to said last recited means and to said memory means for resetting said memory means.

6. A method for guiding a submerged vehicle toward a target comprising the steps of launching a vehicle having an automatic homing mechanism in the vicinity of a target, observing the relative bearings of the vehicle and the target, placing a plurality of sources of sonic impulses generally to the right and left of the approximate course of the torpedo, remotely triggering either the first or the second pulse source depending upon the direction in which the vehicle is to be turned, and permitting the vehicle to make the final approach to the target under control of its automatic homing mechanism.

7. A method of guiding a vehicle toward a submerged target comprising the steps of launching a vehicle capable of responding to sonic commands and possessing an automatic homing mechanism, observing the relative bearings of both the vehicle and the target from a tracking vehicle by means of a suitable underwater surveillance system, and steering the vehicle toward the target by generating coded sonic commands while at the same time observing the relative positions of the vehicle and the target until the vehicle has approached the target within range of its automatic homing mechanism and thereafter transferring control of the vehicle to its automatic homing mechanism whereby the final approach of the vehicle to the target is completed.

8. The method of claim 7 wherein the coded sonic pulses are generated by the step of firing a gun into the sea at a programmed rate.

9. A guidance system for a propelled water vehicle having a steering mechanism, a hydrophone for detecting sonic signals, and a homing system responsive to detected sonic signals generated by a short range target to control said steering mechanism comprising:

means for tracking an indicating the relative paths of the vehicle and target;

means for generating sonic command signals in the water correlative to the indication on said tracking means, means for eliminating spurious signals detected by said hydrophone, gating means for passing said sonic command signals detected during a predetermined operational period, and means for applying said sonic command signals to the steering mechanism during a predetermined period.

* * * * *